US008853967B2

(12) United States Patent
Wilcox et al.

(10) Patent No.: US 8,853,967 B2
(45) Date of Patent: Oct. 7, 2014

(54) LAMP DRIVER HAVING A SHUTDOWN INTERFACE CIRCUIT

(75) Inventors: Kurt S. Wilcox, Libertyville, IL (US); Pierre Deschenes, Muskego, WI (US); Matthew K. Murphy, Mukwonago, WI (US); Bernd Clauberg, Schaumburg, IL (US)

(73) Assignee: Cree, Inc., Durham, NC (US)

( * ) Notice: Subject to any disclaimer, the term of this patent is extended or adjusted under 35 U.S.C. 154(b) by 82 days.

(21) Appl. No.: 13/524,607

(22) Filed: Jun. 15, 2012

(65) Prior Publication Data

US 2013/0334967 A1 Dec. 19, 2013

(51) Int. Cl.
*H05B 37/02* (2006.01)

(52) U.S. Cl.
USPC ..... 315/306; 315/224; 315/307

(58) Field of Classification Search
USPC ..... 315/209 R, 224, 246, 247, 291, 293, 315/294, 297, 306, 307, 308
See application file for complete search history.

(56) References Cited

U.S. PATENT DOCUMENTS

| | | | | |
|---|---|---|---|---|
| 4,395,660 | A | 7/1983 | Waszkiewicz | |
| 6,593,709 | B2 | 7/2003 | Lee et al. | |
| 7,221,107 | B2 | 5/2007 | Melis | |
| 7,391,169 | B2 | 6/2008 | Huang et al. | |
| 7,550,934 | B1 * | 6/2009 | Deng et al. | 315/308 |
| 7,722,220 | B2 | 5/2010 | Van De Ven | |
| 7,862,214 | B2 | 1/2011 | Trott et al. | |
| 7,956,553 | B2 | 6/2011 | Chen et al. | |
| 8,598,071 | B1 | 12/2013 | Ji et al. | |
| 2002/0097008 | A1 * | 7/2002 | Krummel | 315/291 |
| 2010/0013405 | A1 | 1/2010 | Thompson et al. | |
| 2010/0327765 | A1 | 12/2010 | Melanson et al. | |
| 2011/0057576 | A1 * | 3/2011 | Otake et al. | 315/291 |
| 2011/0254469 | A1 | 10/2011 | Ruan et al. | |
| 2012/0062138 | A1 * | 3/2012 | Wilson et al. | 315/254 |
| 2012/0286686 | A1 * | 11/2012 | Watanabe et al. | 315/224 |
| 2013/0154491 | A1 * | 6/2013 | Hawley | 315/200 R |

OTHER PUBLICATIONS

International Electrotechnical Commission, Standard 60929, Annex E, "Control Interface for Controllable Ballasts," 2006 (2 pages).

* cited by examiner

*Primary Examiner* — Tung X Le
(74) *Attorney, Agent, or Firm* — McCraken & Frank LLC

(57) ABSTRACT

A lamp driver responsive to a control signal that is variable in a predetermined control range includes a circuit operable in response to a value of the control signal within the predetermined control range to develop a first current and a lamp control voltage dependent upon the value of the control signal. A shutdown interface is operable in response to a value of the control signal outside of the predetermined control range to develop a second current to turn off a lamp.

22 Claims, 6 Drawing Sheets

LAMP DRIVER HAVING A SHUTDOWN INTERFACE CIRCUIT

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the invention

The present invention relates generally to lamp drives, and more particularly to a lamp drive having a shutdown interface circuit.

2. Description of the Background of the Invention

Lamp drivers have been devised that provide power to one or more lamp loads, such as one or more LEDs arranged in one or more modules. The LEDs, particularly of late, develop a very bright light output but consume relatively little power compared to other types of lamps that develop a comparable light output brightness.

Prior lamp drivers have utilized electromechanical contactors that are responsive to a shutdown signal supplied by a user-operable switch to deactuate the lamp(s). While these types of drivers have been useful to allow a lamp load to be shut down, the use of electromechanical contactors has been problematic in that the contactors are expensive, subject to failure, and contribute to operational cost.

The International Electrotechnical Commission (IEC) has published standard 60929, Annex E, entitled "Control Interface for Controllable Ballasts" (© IEC:2006) that specifies operational parameters for controllable ballasts. The specification recites that the controllable ballast must be responsive to an input control signal across input conductors that varies in a control range between zero volts and 11 volts to operate a lamp connected to the ballast in a stable manner so that the lamp develops stable light output. The IEC standard further specifies that as the input control signal varies between 1 and 10 volts, the arc power of the controllable ballast must similarly vary between minimum and maximum values. Still further, the controllable ballast must also be capable of operating as a current source and must be operable with any voltage between −20 V and +20 V across the input conductors without damage.

While the IEC standard is effective to specify the design of a controllable ballast, no provision is supplied for shutting down a lamp controlled by the ballast.

SUMMARY OF THE INVENTION

According to one aspect of the present invention, a lamp driver responsive to a control signal that is variable in a determined control range includes a first circuit operable in a first operational mode in response to a value of the control signal within the determined control range to develop a first lamp control parameter that controls a lamp dependent upon the value of the control signal. The lamp driver further includes a second circuit operable in a second operational mode in response to a value of the control signal outside of the determined control range to develop a second lamp control parameter to control the lamp in a manner different than the first operational mode. The second circuit is operable when the control signal is outside the control range to sink current.

According to another aspect of the present invention, a lamp driver is responsive to a control signal that is variable in a determined control range. The lamp driver includes a circuit operable in response to a value of the control signal within the determined control range to develop a first current and a lamp control voltage dependent upon the value of the control signal. A solid-state shutdown interface is operable in response to a value of the control signal outside of the determined control range to develop a second current to turn off a lamp.

According to a further aspect of the present invention, a lighting apparatus includes an LED module and a control module that develops a control signal having a selectably variable magnitude within a determined control range to command operation of the LED module at a selected brightness. The control module is further capable of developing a control signal having a magnitude outside the control range. A circuit is responsive to a magnitude of the control signal within the determined control range to supply a constant current magnitude and a variable lamp control voltage to the LED module dependent upon the value of the control signal. A solid-state shutdown interface is operable in response to a value of the control signal outside of the determined control range to sink current to turn off the LED module.

According to yet another aspect of the present invention, a lighting apparatus includes an LED module and a control module that develops a control signal having a selectable variable voltage magnitude within a predetermined control range to command operation of the LED module at a selected brightness. The control module is further capable of developing a control signal having a magnitude outside the control range. A circuit is responsive to the magnitude of the control signal within the predetermined control range to supply a constant current magnitude and a variable lamp control voltage to the LED module dependent upon the value of the control signal, An isolated solid-state shutdown interface is coupled to the primary winding and is operable in response to a value of the control signal outside of the predetermined control range to sink current and thereby turn off the LED module.

BRIEF DESCRIPTION OF THE DRAWINGS

Further aspects of the present invention will become evident by a reading of the attached specification and inspection of the attached drawings in which.

DETAILED DESCRIPTION OF THE PREFERRED EMBODIMENTS

Figure 1:
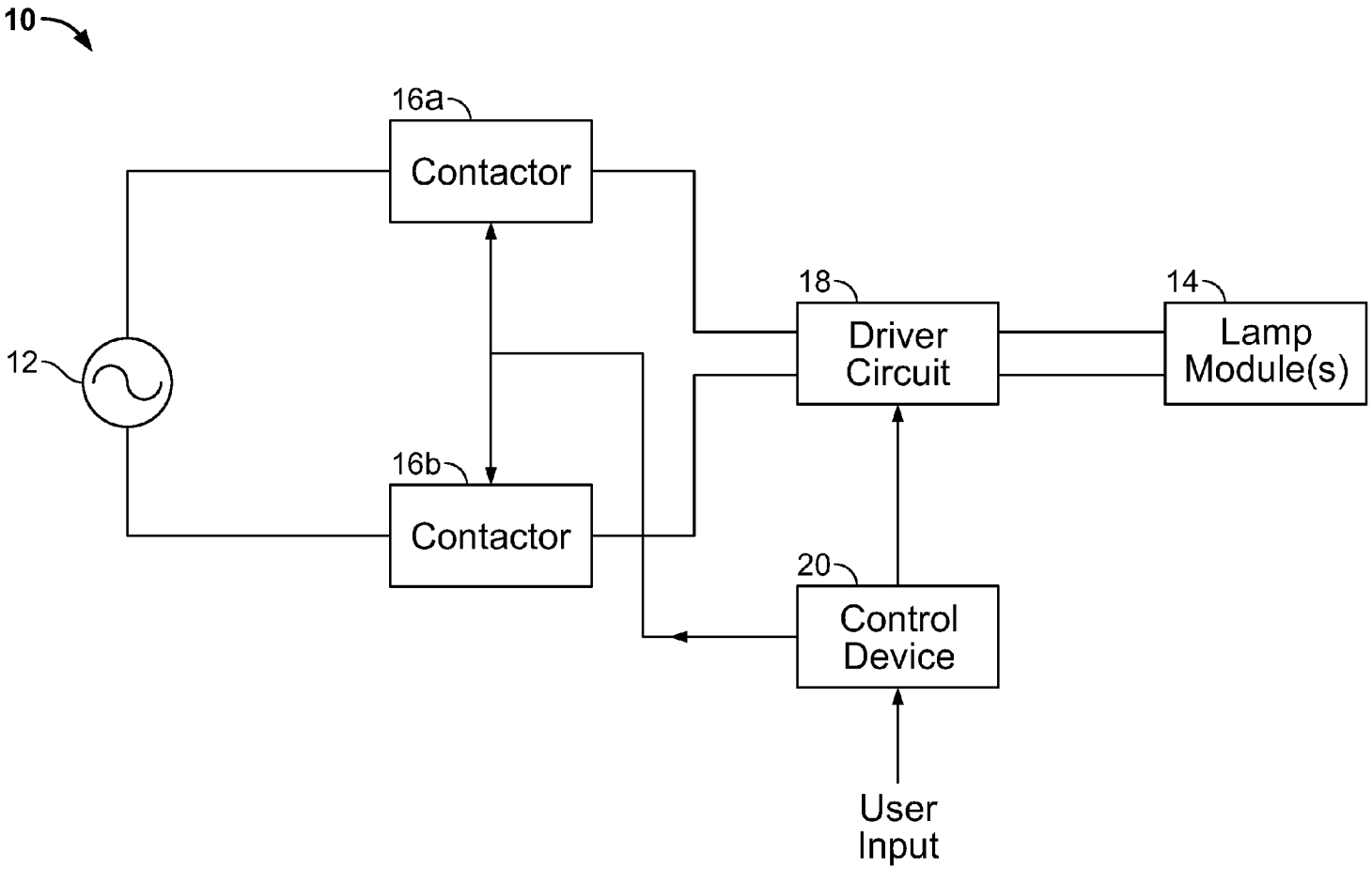
FIG. 1 (Prior Art)
FIG. 1 comprises a block diagram of a prior art lamp driver.

Referring first to FIG. 1, a prior art lamp driver 10 is responsive to alternating current power supplied by a power source 12 and provides power to one or more lamp modules 14. Each lamp module 14 typically comprises one or more light emitting diodes (LEDs) that may be of the high-performance type. A set of contactors 16*a*, 16*b* interconnects the power source 12 with a driver circuit 18. A control device 20 is responsive to a user input and, optionally, one or more other parameters, such as sensed ambient light, time of day, or the like, to close the contactors 16*a*, 16*b* and cause the driver circuit 18 to supply power to the lamp modules 14, as desired. Specifically, the driver circuit 18 provides a constant current to the lamp modules 14 and further delivers a control voltage dependent upon the user input to permit dimming of the lamp modules 14.

As noted previously, the use of the contactors 16*a*, 16*b* can be problematic in that such devices are expensive, prone to failure, and undesirably increase the operational cost of the circuit. In addition, provision must be made to open the contactors 16*a*, 16*b* when the control device commands the driver circuit 18 to turn off the lamp modules 14.

Figure 2:
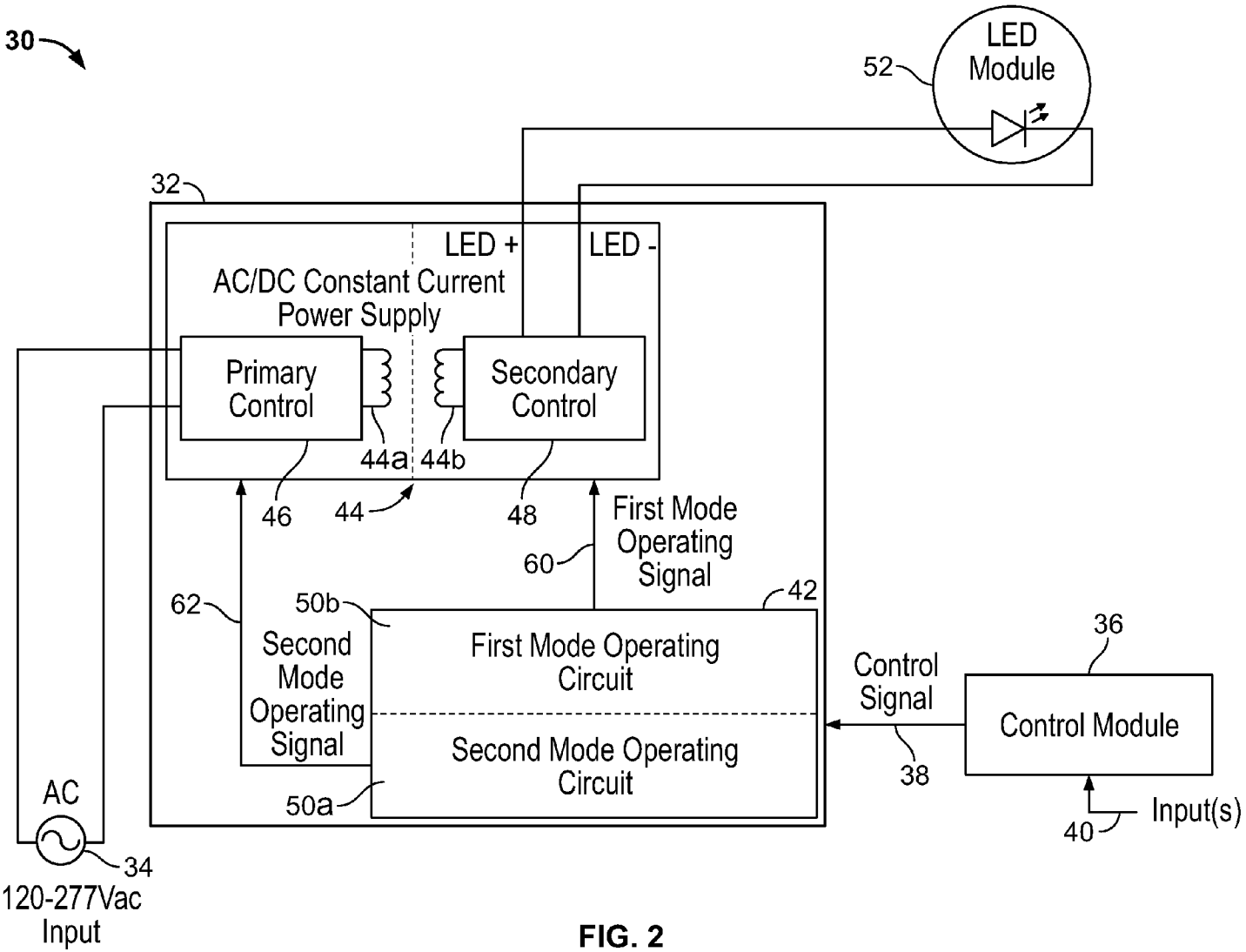
FIG. 2 comprises a block diagram of a generalized lamp driver according to the present invention.

FIG. 2 illustrates an embodiment of the present invention. A lamp driver circuit 32 receives AC power from a power source 34. The driver circuit 32 is responsive to a control signal developed by a control module 36 on one or more conductors 38. The control module 36 may be responsive to one or more input signals supplied on one or more lines 40.

The driver circuit 32 includes a drive control circuit 42, a pair of inductors 44*a*, 44*b* linked by mutual inductance and first and second (or primary and secondary) control circuits 46, 48, respectively. The primary control circuit 46 is responsive to a second mode operating signal developed on one or more conductors 62 by a second mode operating circuit 50*a* comprising a part of the drive control circuit 42. The switching circuit is coupled to the inductor 44*a* and provides AC power thereto in a manner based on the second mode operating signal.

The secondary control circuit 48 is responsive to a first mode operating signal developed on one or more conductor (s) 60 by a first mode operating circuit 50*b* also comprising a part of the drive control circuit 42. The LED module(s) 52 receive one or more controlled parameter(s) of electrical power, such as voltage, current, real or reactive power, frequency, magnitude, duty ratio, etc. during normal dimmer operation from the secondary circuit based on a parameter of the control signal supplied by the control module 36.

Figure 3:
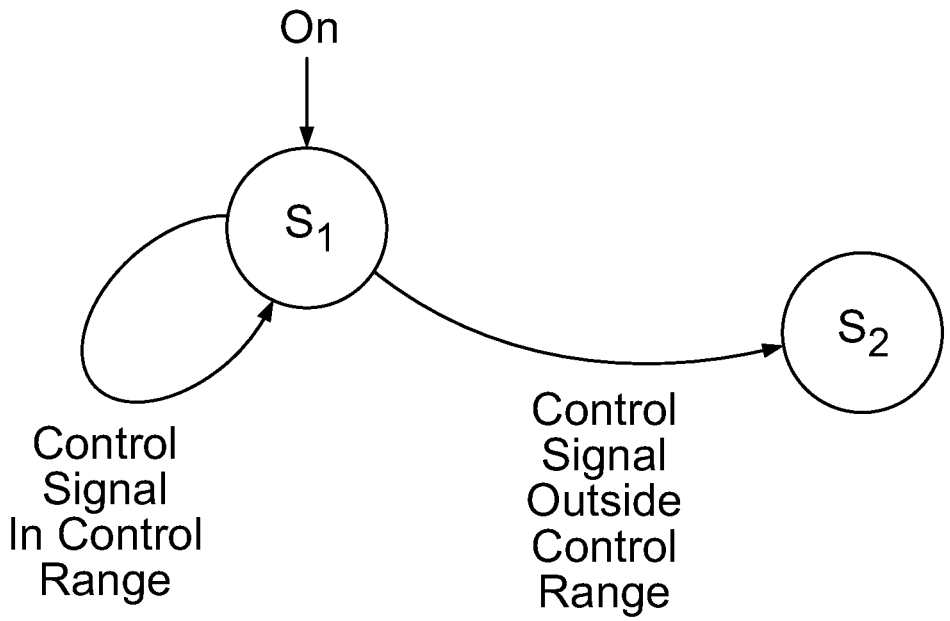
FIG. 3 comprises a state diagram of the operation of the lamp driver of FIG. 2.

FIG. 3 illustrates a sample state diagram illustrating the operation of the embodiments disclosed herein, including the embodiment of FIG. 2. When the components of FIG. 2, for example, are provided power, the driver circuit 32 initially operates in a first state SI comprising the first operating mode in which the primary control 46 supplies AC power to the inductor 44*a* and the secondary control 48 is operated to produce one or more waveforms for a lamp, such as an LED module 52, in accordance with the control signal developed on the conductor(s) 38. Operation in this mode continues as long as a parameter of the control signal on the conductor(s) 38 remains within a determined control range. Once a parameter of the control signal assumes a value outside of the determined control range, operation transitions to a state S2 comprising the second operating mode in which the primary control 46 receives a second mode operating signal developed by the second mode operating circuit 50*a* on the conductor(s) 62. The second operating mode may be any operating mode different than the first operating mode.

Control may remain in the state S2 (i.e., the second operating mode) until the circuit 32 is turned off and turned back on, whereupon control again initiates in the state S1 (i.e., the first operating mode). Alternatively, control may return to the state S1 when the control signal returns to a value within the determined control range.

Figure 5:
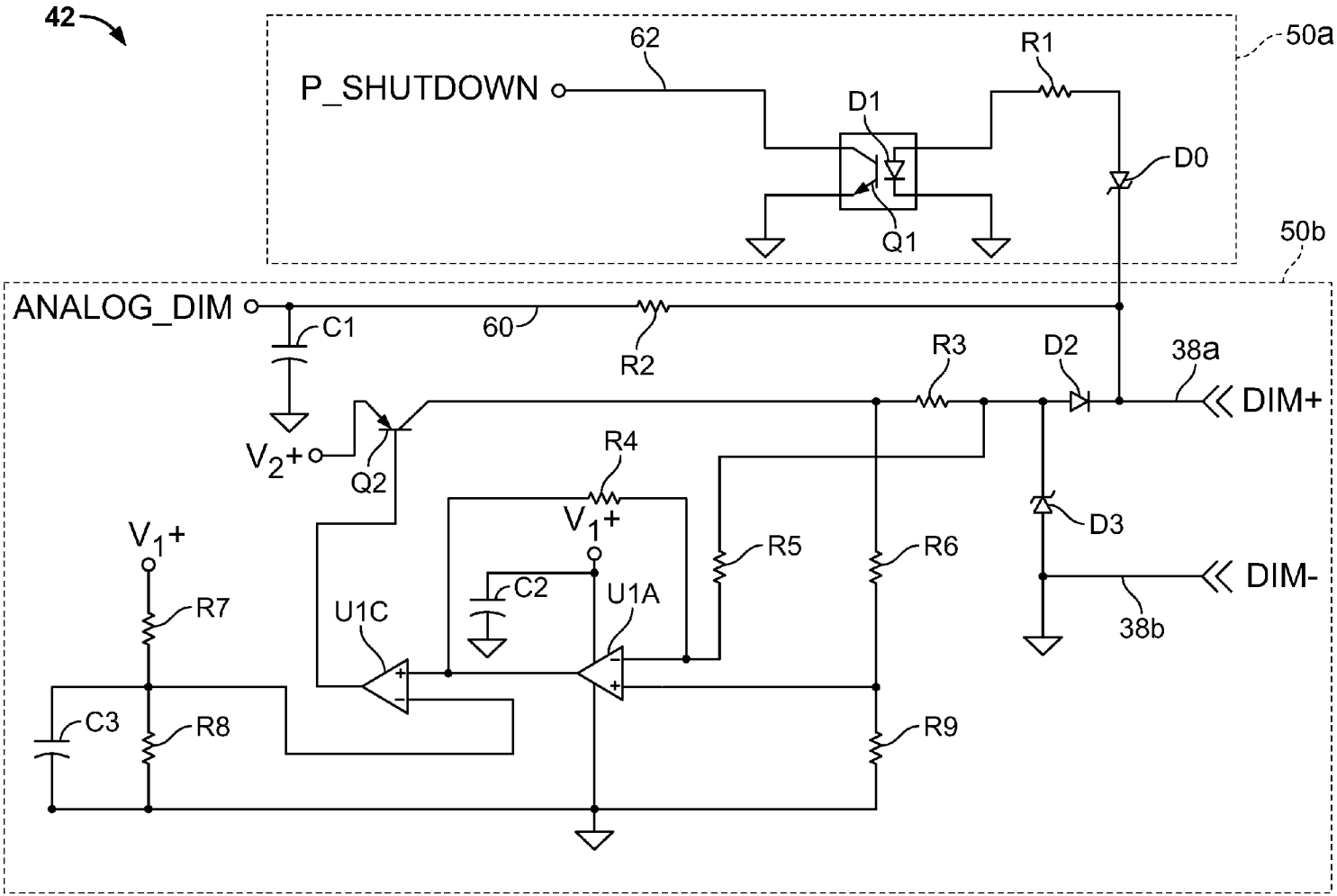
FIG. 5 comprises a schematic diagram of the driver circuit and shutdown interface of FIG. 4.

FIGS, 4-6 illustrate a further embodiment of the present invention. As in the previous embodiment, the driver circuit 32 is responsive to a control signal developed by the control module 36 on a pair of conductors 38*a*, 38*b* (both conductors are shown in FIG. 5). The control module 36 may be responsive to one or more input signals DMX input, DALI input, and Triac input supplied on conductors 40*a*-40*c*, respectively, These signals are developed by circuitry well-known by those of ordinary skill in the art, and, accordingly, will not be described in greater detail herein.

Figure 4:
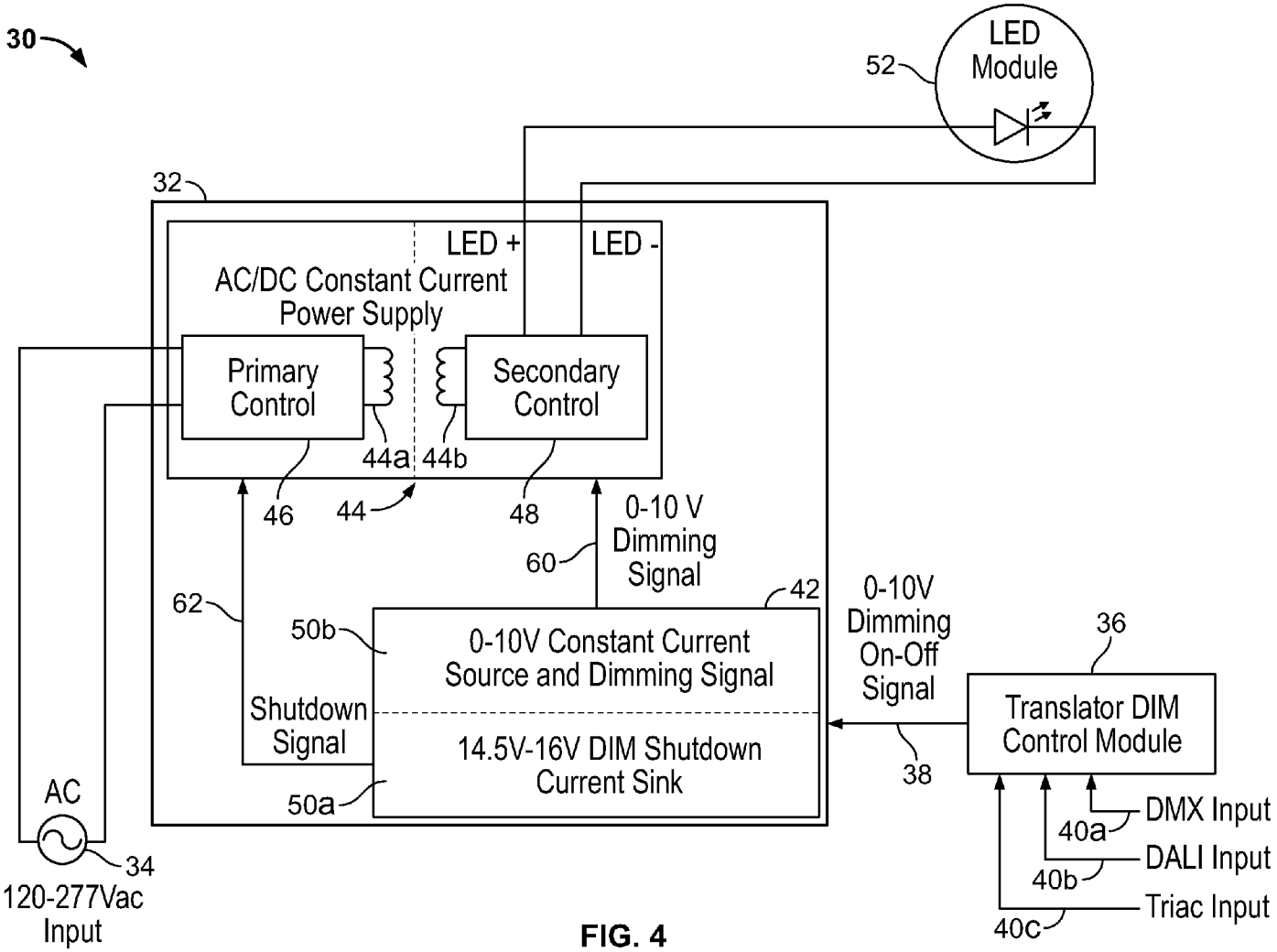
FIG. 4 comprises a block diagram of a lamp drive according to a specific aspect of the present invention.
Figure 6:
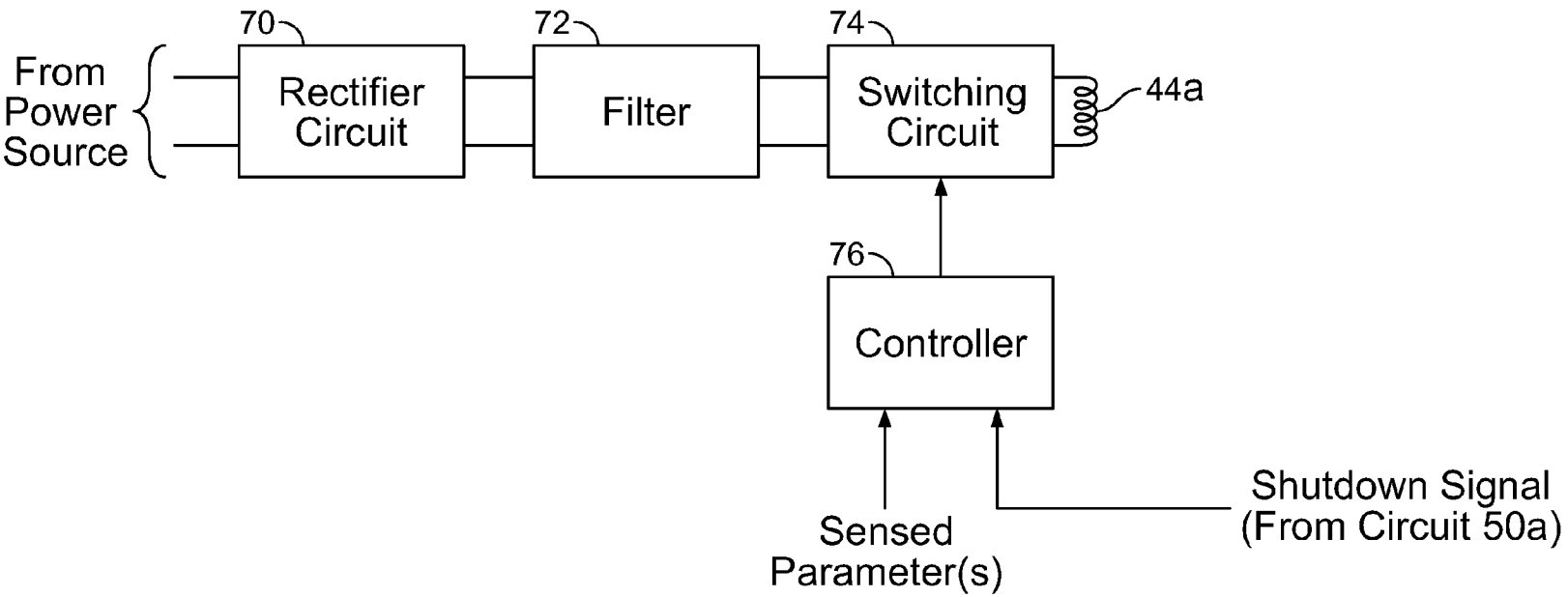
FIG. 6 comprises a block diagram of the primary control circuit of FIG. 5.

The driver circuit 32 includes the drive control circuit 42, the pair of inductors 44*a*, 44*b* linked by mutual inductance and the first and second (or primary and secondary) control circuits 46, 48, respectively. The primary control circuit 46 comprises any known switching power supply (such as, but not limited to, a power factor control (PFC), a flyback LLC, half bridge control, a quasi resonant flyback control, etc.) that is responsive to a shutdown signal developed on the conductor 62 by the second mode operating circuit 50*a* here comprising a shutdown current circuit 50*a*. In the embodiment seen in FIG. 6, the primary control circuit includes a full- or half-wave rectifier circuit 70, a filter 72 including one or more reactive filtering impedance(s) coupled to the rectifier circuit 70, and a switching circuit 74 coupled to the filter 72 and operated by a switching controller 76. The switching controller 76 is responsive to one or more sensed operating parameters, such as a parameter of electrical power supplied to the one or more LED module(s) 52 coupled to the secondary control 48 (FIG. 4). The switching circuit is coupled to the inductor 44*a* and provides AC power thereto. The shutdown signal developed by the shutdown current circuit 50*a* is preferably coupled to the controller 76 and controls the latter as noted in greater detail hereinafter.

The secondary control circuit 48 is responsive to a dimming signal developed by the first mode operating circuit 50*b* comprising a constant current source and dimming signal circuit. The LED module(s) 52 receive a controlled current during normal dimmer operation from the secondary circuit and further are operated at a voltage level based on the operating signal developed by the circuit 50*b*. This signal is, in turn, determined by the level of the 0-10 volt dimming signal supplied by the control module 36. Significantly, there are no mechanical or electromechanical components in either of the primary or secondary controls 46, 48, such as contactors, and hence, the control circuits 46, 48 are advantageously solid-state.

It should be noted that any or all of the circuits shown in any of the FIGS. may be implemented by hardware (including discrete and/or integrated components on an IC), software, and/or firmware wherein the software and/or firmware implements programming executed by one or more devices including, for example, a processor and/or an ASIC, or a combination of any of the foregoing.

FIG. 5 illustrates the drive control circuit 42 in greater detail. As noted previously, the constant current source and dimming signal circuit 50*b* is responsive to a 0-10 volt dimming signal developed between conductors 38*a*, 38*b*. The 0-10 volt dimming signal developed between the conductors 38*a*, 38*b* results from the control module 36 placing a variable impedance across conductors 38*a* and 38*b* and sinking the constant current sourced from the module 50*b* through the variable impedance. The operation of the module 50*b* is effected by diode D3, capacitors C1-C3, resistors R2-R9, transistor Q2, and op amps U1A and U1C that together develop a signal ANALOG_DIM, which is delivered to the secondary control circuit 48 over one or more conductors 60. As noted by the IEC standard 60929, appendix E, noted above, the drive control circuit 42 must be responsive to a voltage across the conductors 38*a*, 38*b* in a control range between 0 volts and 11 volts to dim the LED module 52. Also in accordance with the IEC standard, the voltage across the conductors 38*a*, 38*b* may assume any level between −20 V and +20 V. In accordance with the present invention, when a voltage is developed across the lines 38*a*, 38*b* outside of the control range but within the voltage limits specified by the IEC standard, for example, at a level greater than 14.5 volts and less than 16 volts, the shutdown current circuit 50*a* becomes operative. Specifically, a zener diode D0 encounters a reverse breakdown condition when the voltage across the conductors 38*a*, 38*b* is in the range between 14.5 and 16 volts. A diode D2 becomes reverse-biased under this condition and causes the controller 42 to change operation from a current source to a current sink. This allows current to flow through a resistor R1 and an LED D1 of an opto-isolator Q1. A transistor portion of the opto-isolator Q1 is thereby gated into conduction, in turn resulting in development of a low state signal P_SHUTDOWN. This low state shutdown signal is applied over one or more conductors 62 to the primary control circuit 46 and causes shutdown of the primary control circuit 46. The opto-isolator isolates the power source 34 and the inductor 44*a* from the control module 36. It should be noted that the isolation afforded by the opto-isolator Q1 may instead be provided by any other element or elements capable of providing galvanic isolation, such as a transformer, an optical fiber cable, or the like, as desired. In addition, under this operation, the constant current source and dimming signal circuit 50*b* ceases supply of current to the control module 36. The diode D2, which is provided to protect against damage caused by reverse polarity voltages on the conductors 38*a*, 38*h*, further isolates the shutdown current circuit 50*a* from a portion of the constant current source and dimming signal circuit 50*b* during this time. The LED module(s) 52 are shut down in rapid fashion.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A lamp driver responsive to a control signal that is variable in a determined control range, comprising:

a first circuit operable in a first operational mode in response to a value of the control signal within the determined control range to develop a first lamp control parameter that controls a lamp dependent upon the value of the control signal; and a second circuit operable in a second operational mode in response to a value of the control signal outside of the determined control range to develop a second lamp control parameter to control the lamp in a manner different than the first operational mode, and wherein the second circuit is operable when the control signal is outside the control range to sink current.

2. The lamp driver of claim 1, wherein the first circuit comprises a constant current source.

3. The lamp driver of claim 2, wherein the second circuit comprises a shutdown circuit.

4. The lamp driver of claim 1, wherein the first circuit is operable when the control signal is within the control range to supply a constant current.

5. The lamp driver of claim 4, wherein the second circuit comprises a shutdown circuit operable in the second operational mode to shut down the lamp.

6. The lamp driver of claim 5, wherein the lamp driver initiates operation in the first operational mode when power is initially applied to the lamp driver and remains in the first operational mode until the value of the control signal is outside of the determined control range.

7. The lamp driver of claim 6, wherein the lamp comprises at least one LED module.

8. A lamp driver responsive to a control signal that is variable in a determined control range, comprising:

a circuit operable in response to a value of the control signal within the determined control range to develop a first current and a lamp control voltage dependent upon the value of the control signal; and a shutdown interface operable in response to a value of the control signal outside of the determined control range to develop a second current to turn off a lamp.

9. The lamp driver of claim 8, wherein the circuit comprises a constant current source when the first current is developed.

10. The lamp driver of claim 9, wherein the shutdown interface comprises a current sink when the second current is developed.

11. The lamp driver of claim 8, wherein the shutdown interface includes an isolation element.

12. The lamp driver of claim 11, wherein the isolation element comprises an opto-isolator.

13. The lamp driver of claim 8, in combination with a lamp module.

14. The lamp driver of claim 8, wherein the first current has a constant magnitude and the control signal has a variable voltage magnitude.

15. A lighting apparatus, comprising:

an LED module;

a control module that develops a control signal having a selectable variable magnitude within a determined control range to command operation of the LED module at a selected brightness and wherein the control module is further capable of developing a control signal having a magnitude outside the control range;

a circuit responsive to the magnitude of the control signal within the determined control range to supply a constant current magnitude and a variable lamp control voltage to the LED module dependent upon the value of the control signal; and a solid-state shutdown interface operable in response to the magnitude of the control signal outside of the determined control range to sink current to turn off the LED module.

16. The lighting apparatus of claim 15, wherein the shutdown interface includes an isolation element coupled to the circuit.

17. The lamp driver of claim 16, wherein the isolation element comprises an opto-isolator.

18. The lamp driver of claim 15, further including mutually linked inductors having a primary winding connectable to a source of AC power and a secondary winding coupled to a secondary control circuit.

19. A lighting apparatus, comprising:

an LED module;

a control module that develops a control signal having a selectable variable voltage magnitude within a predetermined control range to command operation of the LED module at a selected brightness and that further is capable of developing a control signal having a magnitude outside of the predetermined control range;

a circuit including a primary winding and a secondary winding and responsive to the magnitude of the control signal within the predetermined control range to supply a constant current magnitude and a variable lamp control voltage to the LED module dependent upon the value of the control signal; and an isolated solid-state shutdown interface coupled to the primary winding operable in response to the magnitude of the control signal outside of the predetermined control range to sink current to turn off the LED module.

20. The lighting apparatus of claim 19, wherein the circuit further includes a primary control circuit responsive to the shutdown interface and a secondary control circuit responsive to the circuit.

21. The lighting apparatus of claim 20, wherein the shutdown interface comprises means for isolating the primary winding from components coupled to the secondary winding.

22. The lighting apparatus of claim 21, wherein the isolating means comprises an opto-isolator.

* * * * *